US008670583B2

(12) United States Patent
Endo et al.

(10) Patent No.: US 8,670,583 B2
(45) Date of Patent: Mar. 11, 2014

(54) HEARING AID SYSTEM

(75) Inventors: Mitsuru Endo, Tokyo (JP); Koichiro Mizushima, Kanagawa (JP); Takeo Kanamori, Osaka (JP)

(73) Assignee: Panasonic Corporation, Osaka (JP)

( * ) Notice: Subject to any disclaimer, the term of this patent is extended or adjusted under 35 U.S.C. 154(b) by 49 days.

(21) Appl. No.: 13/145,415

(22) PCT Filed: Jan. 22, 2010

(86) PCT No.: PCT/JP2010/000381

§ 371 (c)(1),
(2), (4) Date: Jul. 20, 2011

(87) PCT Pub. No.: WO2010/084769

PCT Pub. Date: Jul. 29, 2010

(65) Prior Publication Data

US 2012/0020503 A1 Jan. 26, 2012

(30) Foreign Application Priority Data

Jan. 22, 2009 (JP) ..... P2009-012292

(51) Int. Cl.
*H04R 25/00* (2006.01)

(52) U.S. Cl.
USPC ..... 381/312; 381/313

(58) Field of Classification Search
USPC ..... 381/10, 23.1, 312, 122
See application file for complete search history.

(56) References Cited

U.S. PATENT DOCUMENTS 5,696,831 A 12/1997 Inanaga et al.
6,549,633 B1 4/2003 Westermann (Continued)

FOREIGN PATENT DOCUMENTS

EP 1531650 A2 * 5/2005 ..... H04R 25/00
JP 8-9490 1/1996

(Continued)

OTHER PUBLICATIONS

International Search Report issued Feb. 23, 2010 in International (PCT) Application No. PCT/JP2010/000381.

*Primary Examiner* — Brian Ensey
*Assistant Examiner* — Norman Yu
(74) *Attorney, Agent, or Firm* — Wenderoth, Lind & Ponack, LLP

(57) ABSTRACT

Disclosed is a hearing aid system capable of increasing the clearness of sound spoken by a speaker while reproducing the incoming direction of the sound spoken by the speaker without using an inverse mapping rule. The hearing aid system includes a sound source input section which receives sounds coming from sound sources as input to convert the input sounds to first acoustic signals, a sound source separating section which separates the first acoustic signals converted by the sound source input section into sound source signals corresponding to the sound sources, a binaural microphone which is disposed on left and right ears, and receives the sounds coming from the sound sources as input to convert the input sounds to second acoustic signals, a directional sense component calculating section which calculates directional sense components representing the directional sense of the sound sources with the binaural microphone as a base point from the left and right second acoustic signals converted by the binaural microphone, an output signal generating section which generates left and right output acoustic signals on the basis of the sound source signals and the directional sense components, and a binaural speaker which outputs the left and right output acoustic signals generated by the output signal generating section.

9 Claims, 8 Drawing Sheets

(56) References Cited

U.S. PATENT DOCUMENTS

| | | | | |
|---|---|---|---|---|
| 6,862,541 | B2 * | 3/2005 | Mizushima | 702/76 |
| 7,333,622 | B2 | 2/2008 | Algazi et al. | |
| 7,474,758 | B2 * | 1/2009 | Beck et al. | 381/313 |
| 2006/0239468 | A1 * | 10/2006 | Desloge | 381/60 |
| 2007/0009120 | A1 | 1/2007 | Algazi et al. | |
| 2008/0056517 | A1 | 3/2008 | Algazi et al. | |
| 2010/0061568 | A1 * | 3/2010 | Rasmussen | 381/94.1 |

FOREIGN PATENT DOCUMENTS

| | | | | | |
|---|---|---|---|---|---|
| JP | 9-140000 | | | 5/1997 | |
| JP | 09140000 | A | * | 5/1997 | H04R 27/02 |
| JP | 2002-504794 | | | 2/2002 | |
| JP | 2004-23180 | | | 1/2004 | |
| JP | 2005-268964 | | | 9/2005 | |
| JP | 2006-503526 | | | 1/2006 | |
| JP | 2007-336460 | | | 12/2007 | |

* cited by examiner

HEARING AID SYSTEM

BACKGROUND OF THE INVENTION

I. Technical Field

The present invention relates to a hearing aid system.

II. Description of the Related Art

JP-A-9-140000 describes a hearing aid system which directs the directionality of a microphone array toward a speaker to clarify sound collected by the microphones. JP-A-8-9490 and JP-A-2004-23180 describe a sound image localization technique in which the rotation angle of the head of a person with headphones is detected by a sensor, such as a digital vibrating gyroscope or a camera, and even when the head of the person with the headphones rotates, a virtual sound image is not moved. JP-A-2006-503526 describes a method for detecting the rotation angle of a head by using a head tracker.

When the sound image localization technique described in JP-A-8-9490 and the hearing aid system described in JP-A-9-140000 are combined, for example, the hearing aid system shown in FIG. 10 can be realized. FIG. 10 is a block diagram showing the configuration of a hearing aid system of the related art. The hearing aid system of the related art shown in FIG. 10 includes an external microphone array 900 and a hearing aid 800.

The hearing aid 800 includes a binaural speaker 801, a virtual sound image rotating section 803, an inverse mapping rule storage section 805, a direction reference setting section 809, a head rotation angle sensor 811, and a direction estimating section 813.

The head rotation angle sensor 811 is constituted by, for example, a digital vibrating gyroscope, and detects the rotation angle of the head of a person who wears the hearing aid system.

The direction reference setting section 809 includes a direction reference setting switch. In the direction reference setting section 809, the person who wears the hearing aid 800 operates the direction reference setting switch to set a reference direction which defines the direction of a virtual sound source or to reset the head rotation angle sensor 811.

The head rotation angle sensor 811 detects the rotation of the head of the person who wears the hearing aid 800.

The direction estimating section 813 integrates the rotation angle detected by the head rotation angle sensor 811 in the opposite direction, and determines the direction of the virtual sound source to be localized as the angle from the reference direction set by the direction reference setting switch.

The inverse mapping rule storage section 805 stores an inverse mapping rule which is used to convert the angle determined by the direction estimating section 813 to a directional sense component.

The virtual sound image rotating section 803 rotates the sound image of speech of a speaker separated by a sound source separating section 902 described below in the direction determined by the direction estimating section 813 with reference to the inverse mapping rule.

The binaural speaker 801 expresses the sound image of the speech of the speaker rotated by the virtual sound image rotating section 803 as acoustic signals for left and right ears and outputs the acoustic signals.

The external microphone array 900 includes a sound source input section 901 and a sound source separating section 902.

The sound source input section 901 has a plurality of microphones arranged in a predetermined arrangement, and introduces sound from the outside in multiple channels.

The sound source separating section 902 directs the directionality of the external microphone array 900 toward the speaker to separate the speech of the speaker. The separated speech of the speaker is transferred to the virtual sound image rotating section 803 described above.

In the above-described hearing aid system of the related art, the inverse mapping rule which is used to convert the angle determined by the direction estimating section 813 to a directional sense component is stored in advance, and the direction of the sound image of the speech of the speaker with respect to the person who wears the hearing aid system can be determined with reference to the inverse mapping rule.

SUMMARY OF THE INVENTION

In the above-described hearing aid system of the related art, it is necessary that a mapping relationship between a frequency characteristic expressed by a transfer function, an interaural volume difference, or an interaural time difference and the incoming direction of sound perceived by a person is obtained in advance as a directional sense component which gives a clue when a person perceives the incoming direction of sound, and the sound image is localized from inverse mapping.

An object of the invention is to provide a hearing aid system capable of increasing the clearness of speech spoken by a speaker while reproducing the incoming direction of the speech spoken by the speaker without using an inverse mapping rule.

The invention provides a hearing aid system including: a sound source input section configured to receive sounds coming from sound sources as an input thereof and to convert the input sounds to first acoustic signals; a sound source separating section configured to separate the first acoustic signals converted by the sound source input section into sound source signals corresponding to respective sound sources; a binaural microphone which is disposed at left and right ears and which is configured to receive the sounds coming from the sound sources as an input thereof and to convert the input sounds to second acoustic signals; a directional sense component calculating section configured to calculate a directional sense component representing a directional sense of the sound sources with respect to the binaural microphone as a base point, based on the left and right second acoustic signals converted by the binaural microphone; an output signal generating section configured to generate left and right output acoustic signals based on the sound source signals and the directional sense component; and a binaural speaker configured to output the left and right output acoustic signals generated by the output signal generating section.

According to the hearing aid system of the invention, it is possible to increase the clearness of speech of a speaker while reproducing the incoming direction of the speech of the speaker without using an inverse mapping rule.

In the hearing aid system, the directional sense component calculating section may calculate at least one of an interaural time difference and an interaural volume difference for each of the sound sources based on the left and right second acoustic signals, and may set at least one of the interaural time difference and the interaural volume difference as the directional sense component.

According to the hearing aid system of the invention, it is possible to increase the clearness of speech of a speaker while reproducing the incoming direction of the speech of the speaker without using an inverse mapping rule.

In the hearing aid system, the directional sense component calculating section may calculate, for each of the sound sources, a transfer characteristic between the sound source signal from the sound source separating section and the left and right second acoustic signals from the binaural microphone as the directional sense component.

With the above-described configuration, it is possible to generate a binaural signal difference taking into consideration the frequency characteristics included in the transfer characteristic, thereby realizing a real directional sense.

In the hearing aid system, the directional sense component calculating section may detect an utterance duration from the sound source signal acquired from the sound source separating section for each of the sound sources, and if the utterance durations of a plurality of sound sources are detected simultaneously, the directional sense component calculating section may use a value immediately before the detection of the utterance durations of the plurality of sound sources as the transfer characteristic.

With the above-described configuration, it is possible to prevent degradation in the clearness when there is a large estimation error of the transfer characteristics because of simultaneous utterances.

In the hearing aid system, the directional sense component calculating section may estimate a location of each of the sound sources based on the transfer characteristic, and when the directional sense component calculating section estimates that the location of the sound source is at a person wearing the binaural microphone, the output signal generating section may output the second acoustic signals to the binaural speaker.

With the above-described configuration, when it is determined that a sound source is the person himself/herself who wears the hearing aid, an acoustic signal from a binaural microphone nearer to the sound source is output, such that sound spoken by the person himself/herself who wears the hearing aid can be clearly heard.

According to the hearing aid system of the invention, it is possible to increase the clearness of speech spoken by a person while reproducing the incoming direction of the speech spoken by the person without using an inverse mapping rule.

DETAILED DESCRIPTION OF THE INVENTION

Hereinafter, embodiments of the invention will be described with reference to the drawings.

Embodiment 1

Figure 1:
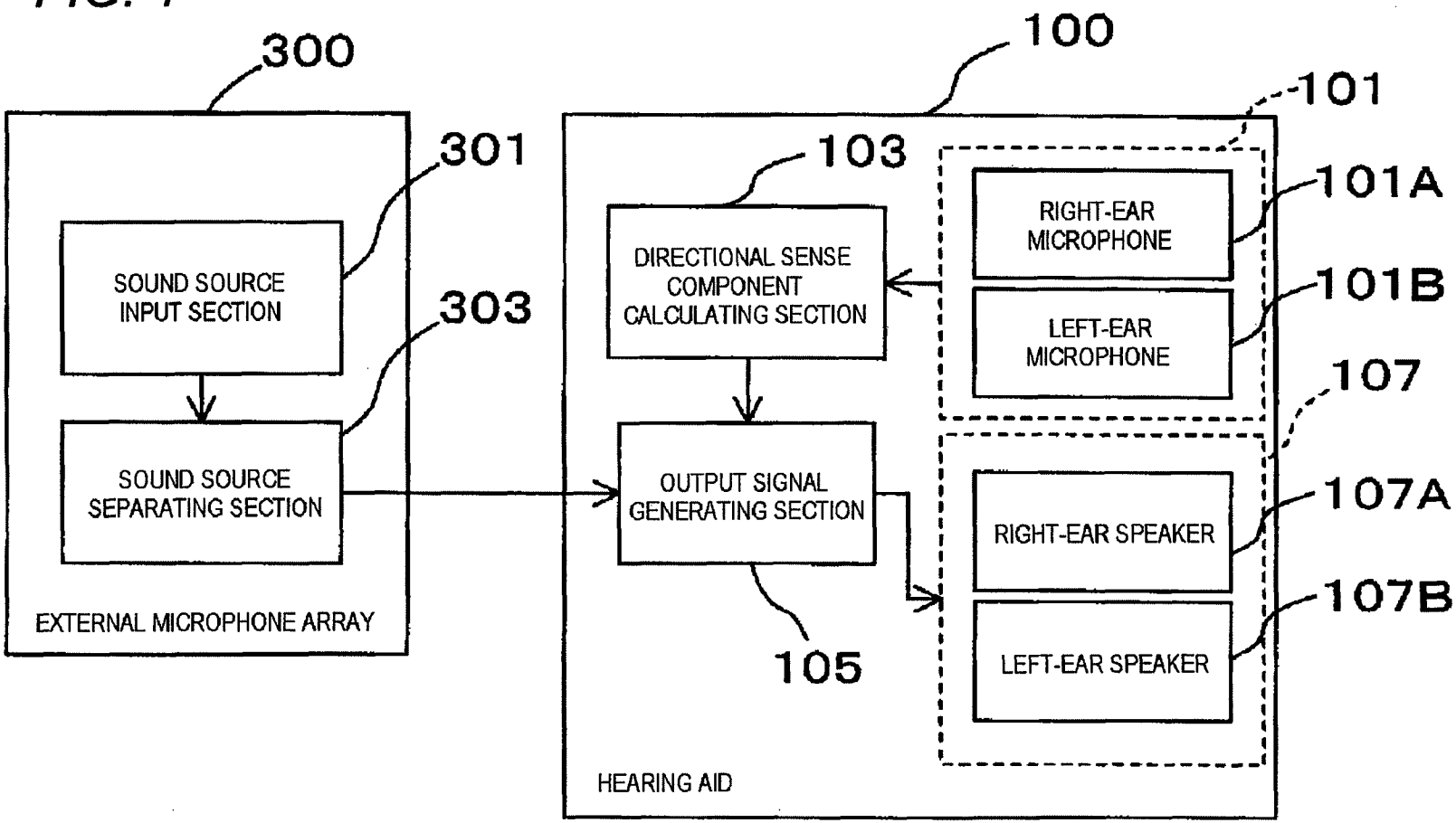
FIG. 1 is a block diagram showing the configuration of a hearing aid system of Embodiment 1.
Figure 3:
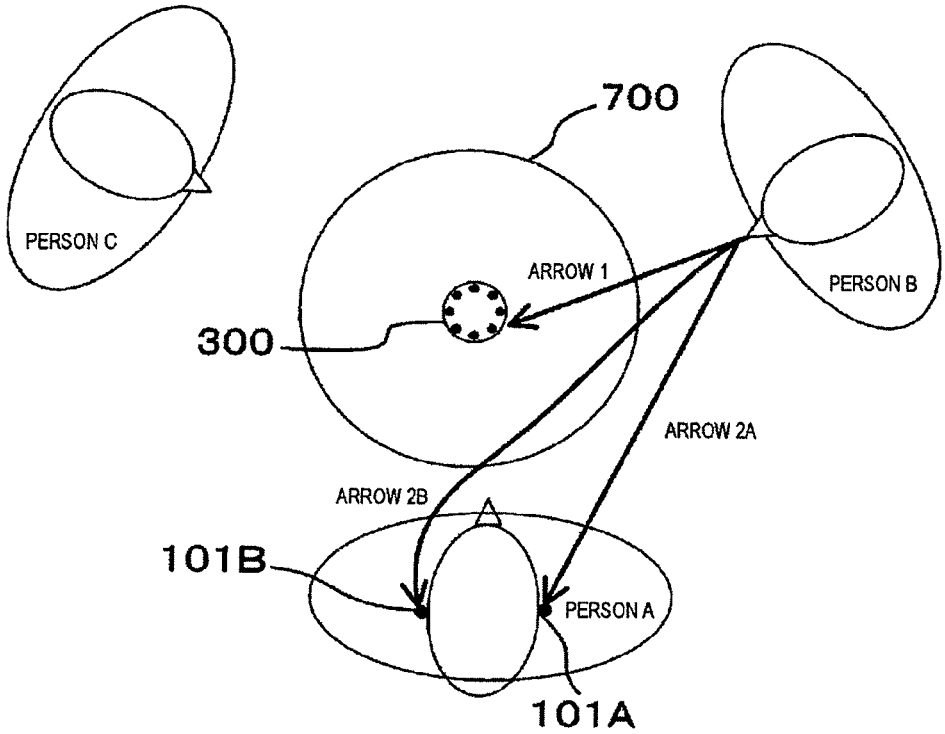
FIG. 3 is a diagram showing a usage example 1 of the hearing aid system of Embodiment 1.
Figure 4:
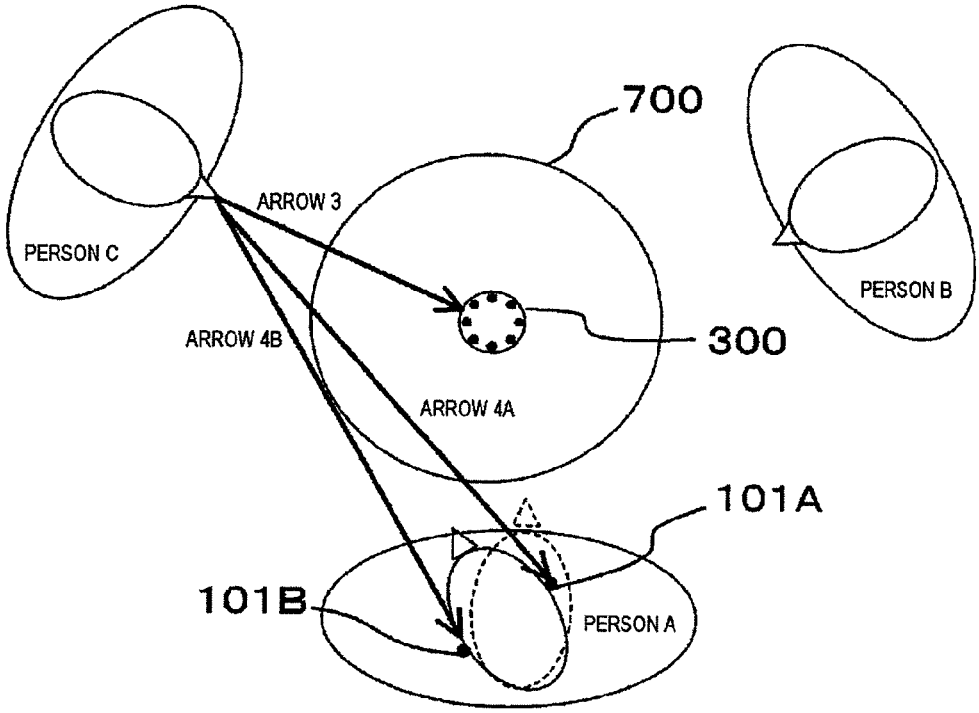
FIG. 4 is a diagram showing a usage example 2 of the hearing aid system of Embodiment 1.

FIG. 1 is a block diagram showing the configuration of a hearing aid system of Embodiment 1. As shown in FIG. 1, the hearing aid system of Embodiment 1 includes a hearing aid 100 and an external microphone array 300. FIG. 3 is a diagram showing a usage example 1 of the hearing aid system of Embodiment 1. FIG. 4 is a diagram showing a usage example 2 of the hearing aid system of Embodiment 1.

Figure 2:
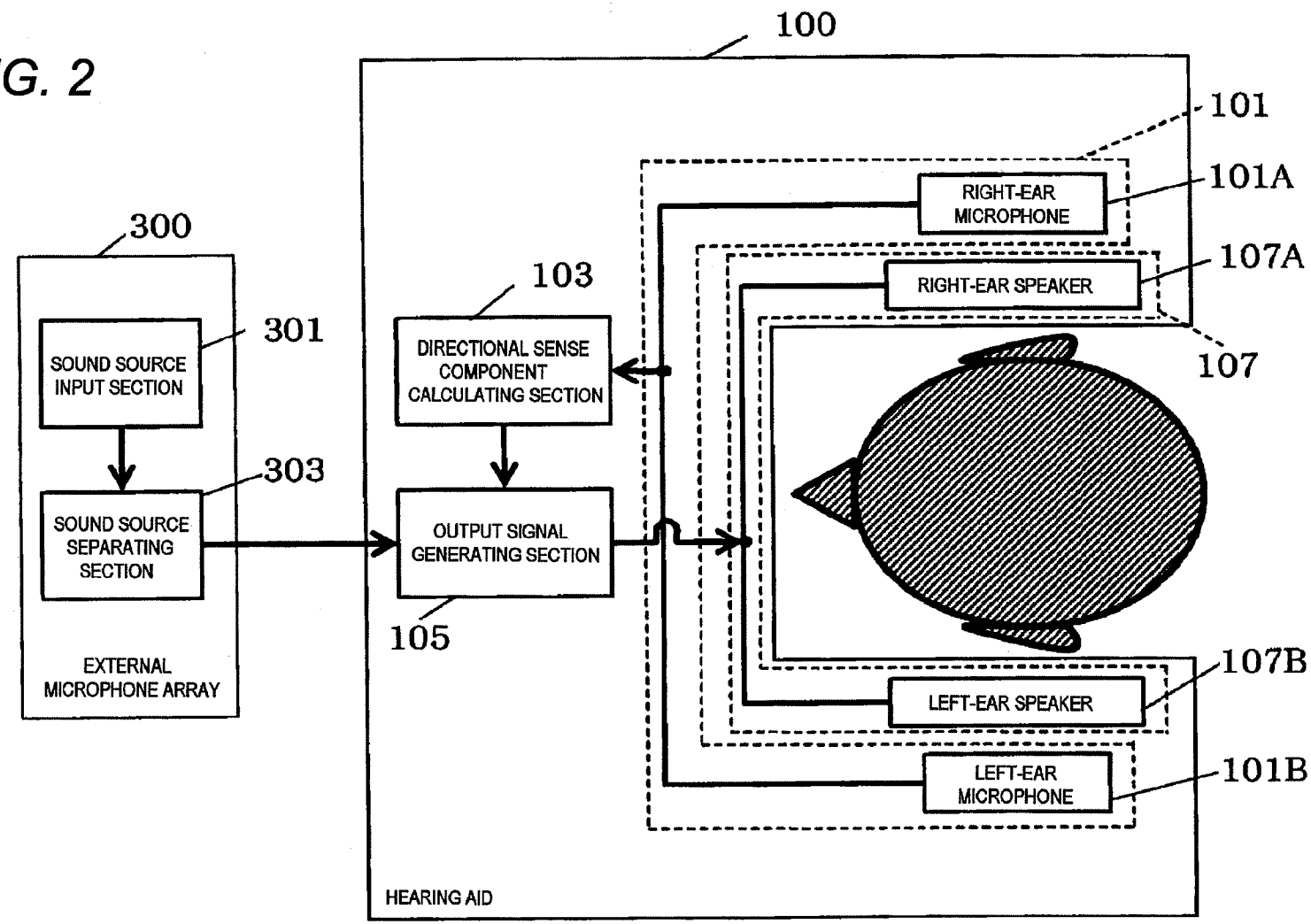
FIG. 2 is a block diagram showing the configuration of the hearing aid system of Embodiment 1 in detail.

FIG. 2 is a block diagram showing the configuration of the hearing aid system shown in FIG. 1 in detail. In FIG. 2, the constituent elements referenced by the same reference numerals as in FIG. 1 have the same functions as the constituent elements in FIG. 1.

The configuration of the hearing aid 100 which constitutes a part of the hearing aid system of Embodiment 1 will be described with reference to FIG. 1. The hearing aid 100 has a right unit which is worn on a right ear and a left unit which is worn on a left ear. The left and right units include microphones for respective ears of a binaural microphone 101, a directional sense component calculating section 103, an output signal generating section 105, and speakers for respective ears of a binaural speaker 107. The left and right units of the hearing aid 100 perform wireless communication with each other. The left and right units of the hearing aid 100 may perform wired communication with each other.

The binaural microphone 101 has a right-ear microphone 101A which constitutes a part of the right unit and a left-ear microphone 101B which constitutes a part of the left unit. The binaural microphone 101 receives sound from sound sources for a person who wears the hearing aid 100 as input to the left and right ears of the person who wears the hearing aid 100 and converts the input sound to acoustic signals.

The directional sense component calculating section 103 calculates an interaural time difference and an interaural volume difference from the acoustic signals converted by the binaural microphone 101 as directional sense components such that the person who wears the hearing aid 100 senses the incoming direction of the sound coming from the sound sources to the person who wears the binaural microphone. That is, the directional sense components represent the directional sense of the sound sources with the person who wears the binaural microphone 101 as a base point.

When the interaural time difference is calculated as a directional sense component, the directional sense component calculating section 103 calculates a mutual correlation value while shifting the time of a right acoustic signal converted by the right-ear microphone 101A and the time of a left acoustic signal converted by the left-ear microphone 101B. The time at which the mutual correlation value is maximized is set as the interaural time difference. When the interaural volume difference is calculated as a directional sense component, the directional sense component calculating section 103 obtains the power ratio of the left and right acoustic signals while shifting the time of the right acoustic signal converted by the right-ear microphone 101A and the left acoustic signal converted by the left-ear microphone 101B by an amount corresponding to the interaural time difference. The directional sense component calculating section 103 sets the power ratio of the left and right acoustic signals as the interaural volume difference.

As described above, the directional sense component calculating section 103 calculates the directional sense components of the sound coming from the sound sources directly from the sound reaching the binaural microphone 101 from the sound sources. For this reason, the hearing aid system of Embodiment 1 can truly reproduce the direction of the sound coming from the sound sources. The directional sense component calculating section 103 may calculate one of the interaural time difference and the interaural volume difference as a directional sense component, and may calculate both the interaural time difference and the interaural volume difference as a directional sense component.

The output signal generating section 105 generates left and right acoustic signals, which will be output from the left and right speakers, from the directional sense components calculated by the directional sense component calculating section 103 and the sound source signals received from the external microphone array 300 described below. The output signal generating section 105 determines which of the left unit and the right unit is distant from the sound sources from the interaural time difference which is one of the directional sense components.

For a unit which is more distant from the sound sources, the output signal generating section 105 delays the sound source signals received from the sound source separating section 303 of the external microphone array 300 described below by the amount corresponding to the interaural time difference. For a unit which is more distant from the sound sources, the output signal generating section 105 controls the volume level of the binaural speaker 107 of the corresponding unit so as to be lowered by an amount corresponding to the interaural volume difference.

For a unit close to the sound sources from the left and right units, the output signal generating section 105 outputs the sound source signals received from the sound source separating section 303 to the binaural speaker 107 as they are.

The binaural speaker 107 has a right-ear speaker 107A which constitutes a part of the right unit and a left-ear speaker 1078 which constitutes a part of the left unit. The binaural speaker 107 outputs the left and right acoustic signals generated by the output signal generating section 105 on the left and right ears of the person who wears the hearing aid 100.

Next, the configuration of the external microphone array 300 which constitutes a part of the hearing aid system of Embodiment 1 will be described with reference to FIG. 1. The external microphone array 300 includes a sound source input section 301 and a sound source separating section 303. In the hearing aid system of Embodiment 1, the external microphone array 300 is provided at a closer location than the binaural microphone 101 of the hearing aid 100. The external microphone array 300 performs wireless communication with the left and right units of the hearing aid 100. The external microphone array 300 may perform wired communication with the left and right units of the hearing aid 100.

The sound source input section 301 receives the sound coming from the sound sources to the external microphone array 300 as input, and converts the input sound to acoustic signals. The sound source input section 301 has a plurality of microphones.

The acoustic signals of the respective microphones converted by the sound source input section 301 are transferred to the sound source separating section 303.

The sound source separating section 303 detects the directions of the sound sources with the external microphone array 300 as a base point using the difference in the incoming time of the sound coming from the sound sources to the microphones.

The sound source separating section 303 adds the acoustic signals of the microphones on the basis of the spatial arrangement of the microphones while taking into consideration the delay time of the sound for the microphones. Thus, the sound source separating section 303 generates the sound source signals subjected to directionality processing toward the sound sources with the external microphone array 300 as a base point, and transmits the sound source signals to the output signal generating section 105 of the hearing aid 100 in a wireless manner.

With regard to the sound source signals generated by the sound source separating section 303, sound coming from a target sound source is highlighted (subjected to directionality processing) with the external microphone array 300 as a base point. For this reason, with regard to the sound source signals generated by the sound source separating section 303, sound other than the sound of the target sound source is suppressed, and the sound of the target sound source is clarified. When the location of the external microphone array 300 is closer to the location of the sound source than the location of the binaural microphone 101, with regard to the sound source signals generated by the sound source separating section 303, the sound of the target sound source is further clarified.

Next, an operation example 1 of the hearing aid system of Embodiment 1 will be described with reference to FIG. 3.

Operation Example 1

As shown in FIG. 3, a person A who wears the hearing aid 100, a person B, and a person C have a meeting around a round table 700 on which the external microphone array 300 is provided near the center thereof. In FIG. 3, while the person B is speaking, the person A looks at the person B obliquely rightward and listens to the utterance of the person B.

First, sound spoken by the person B is input from two microphone systems and converted to acoustic signals. A first microphone system is a plurality of microphones which constitute the sound source input section 301 of the external microphone array 300, and a second microphone system is the binaural microphone 101 of the hearing aid 100.

(First Microphone System)

In the sound source input section 301 of the external microphone array 300, sound (arrow 1) coming from the person B who speaks to the external microphone array 300 is input and converted to acoustic signals. A plurality of microphones which constitute the sound source input section 301 of the external microphone array 300 collects sound spoken by the person B coming from the person B as a sound source.

The acoustic signals converted by the sound source input section 301 are transferred to the sound source separating section 303.

In the sound source separating section 303, a sound source direction which represents the direction of the sound source with the external microphone array 300 as a base point is detected on the basis of a difference in the incoming time of the sound spoken by the person B reaching the microphones.

In the sound source separating section 303, the acoustic signals of the microphones are added on the basis of the spatial arrangement of the microphones while taking into consideration the delay time of the sound for the microphones, and subjected to directionality processing toward the sound source with the external microphone array 300 as a base point. The acoustic signals subjected to the directionality processing are transmitted to the output signal generating section 105 of the hearing aid 100 in a wireless manner as sound source signals subjected to directionality processing toward the sound source with the external microphone array 300 as a base point.

(Second Microphone System)

In the right-ear microphone 101A and the left-ear microphone 101B which constitute the binaural microphone 101 of the hearing aid 100, sound (arrow 2A and arrow 2B) coming from the person B who speaks to the binaural microphone 101 is converted to acoustic signals.

The left and right acoustic signals respectively converted by the right-ear microphone 101A and the left-ear microphone 101B are transferred to the directional sense component calculating section 103.

In the directional sense component calculating section 103, at least one of an interaural time difference and an interaural volume difference is calculated from the left and right acoustic signals converted by the binaural microphone 101 as a directional sense component representing the direction of the sound source with the person who wears the binaural microphone 101 as a base point. In the operation example 1 shown in FIG. 3, since the person A looks at the person B as a sound source rightward, the interaural time difference based on the right-ear microphone 101A has a positive value, and the interaural volume difference (power ratio) has a value equal to or smaller than 1 (arrow 2B is longer than arrow 2A). The directional sense components calculated by the directional sense component calculating section 103 are transferred to the output signal generating section 105.

In the output signal generating section 105, left and right acoustic signals which are output from the binaural speaker 107 are generated from the directional sense components calculated by the directional sense component calculating section 103 and the sound source signals subjected to the directionality processing toward the sound source with the external microphone array 300 as a base point.

In the operation example 1 shown in FIG. 3, the left ear of the person A is more distant from the person B than the right ear of the person A. For this reason, in the output signal generating section 105, the left acoustic signal output from the left-ear speaker 107B of the person A is delayed by the amount corresponding to the interaural time difference as a directional sense component.

In the output signal generating section 105, the left-ear speaker 107B is controlled such that the volume level of the left-ear speaker 107B which outputs the left acoustic signal is lowered by the amount corresponding to the interaural volume difference.

In the output signal generating section 105, the sound source signal received from the sound source separating section 303 is transferred to the right-ear speaker 107A so as to be output from the right-ear speaker 107A as a right acoustic signal.

As described above, in the acoustic signals of the left-ear speaker 107B and the right-ear speaker 107A of the binaural speaker 107, (1) the incoming direction of sound spoken by the person B as a sound source is truly reproduced by the directional sense components which are calculated by the directional sense component calculating section 103 and represent the directional sense of the sound source with the person who wears the binaural microphone 101 as a base point, and (2) the clearness of sound spoken by the person B as a sound source is increased by the sound source signals which are subjected to the directionality processing toward the sound source with the external microphone array 300 as a base point.

Next, an operation example 2 of the hearing aid system of Embodiment 1 will be described with reference to FIG. 4.

Operation Example 2

As shown in FIG. 4, it is assumed that a person A who wears the hearing aid 100, a person B, and a person C have a meeting around a round table 700 on which the external microphone array 300 is provided near the center thereof. In FIG. 4, from the state shown in FIG. 3, the person B stops to speak, and the person A who is looking straight at the external microphone array 300 turns to look straight at the person C who starts to speak and listens to the utterance of the person C.

First, sound spoken by the person C is input from two microphone systems and converted to acoustic signals. A first microphone system is a plurality of microphones which constitute the sound source input section of the external microphone array 300, and a second microphone system is the binaural microphone 101 of the hearing aid 100.

(First Microphone System)

In the sound source input section 301 of the external microphone array 300, sound (arrow 3) coming from the person C who speaks to the external microphone array 300 is input and converted to acoustic signals.

Each of a plurality of microphones which constitute the sound source input section 301 of the external microphone array 300 collects sound spoken by the person C coming from the person C as a sound source.

In the sound source separating section 303, the sound source direction which represents the direction of the sound source with the external microphone array 300 as a base point is detected on the basis of a difference in the incoming time of the sound spoken by the person C reaching the microphones.

In the sound source separating section 303, the acoustic signals of the microphones are added on the basis of the spatial arrangement of the microphones while taking into consideration the delay time of the sound for the microphones, and subjected to directionality processing toward the sound source with the external microphone array 300 as a base point. The acoustic signals subjected to the directionality processing are transmitted to the output signal generating section 105 of the hearing aid 100 in a wireless manner as sound source signals subjected to directionality processing toward the sound source with the external microphone array 300 as a base point.

(Second Microphone System)

In the right-ear microphone 101A and the left-ear microphone 101B which constitute the binaural microphone 101 of the hearing aid 100, sound (arrow 4A and arrow 4B) coming from the person C who speaks to the binaural microphone 101 is input and converted to acoustic signals.

The left and right acoustic signals respectively converted by the right-ear microphone 101A and the left-ear microphone 101B are transferred to the directional sense component calculating section 103.

In the directional sense component calculating section 103, at least one of the interaural time difference and the interaural volume difference is calculated from the left and right acoustic signals converted by the binaural microphone 101 as a directional sense component representing the directional sense of the sound source with the person who wears the binaural microphone 101 as a base point. In the operation example 2 shown in FIG. 4, since the person A who is looking at the person C leftward turns to look straight at the person C, the interaural time difference changes from a positive value to 0 based on the left-ear microphone 101B, and the interaural volume difference (power ratio) changes from a value smaller than 1 to 1 (arrow 4A and arrow 4B have the same length). The directional sense components calculated by the directional sense component calculating section 103 are transferred to the output signal generating section 105.

In the output signal generating section 105, left and right acoustic signals which are output from the binaural speaker 107 are generated from the directional sense components calculated by the directional sense component calculating section 103 and the sound source signals subjected to the directionality processing toward the sound source with the external microphone array 300 as a base point.

The left and right acoustic signals synthesized by the output signal generating section 105 are output from the left-ear speaker 107B and the right-ear speaker 107A of the binaural speaker 107.

In the operation example 2 shown in FIG. 4, while the person A who is looking straight at the external microphone array 300 turns to look straight at the person C, in the output signal generating section 105, the interaural time difference as a directional sense component changes from a value calculated from a measured value to zero. The output signal generating section 105 controls the right-ear speaker 107A such that the volume level of the right-ear speaker 107A is lowered by the amount corresponding to the interaural volume difference, and is gradually identical to the left. For this reason, when the person A looks straight at the external microphone array 300, the utterance of the person C is delayed compared to the left-ear speaker 107B on the left ear and low sound is output from the right-ear speaker 107A on the right ear. However, as the person A who is looking straight at the external microphone array 300 turns to look at the person C, the utterance of the person C is not delayed, and sound changes to be output at the same level from the left-ear speaker 107B and the right-car speaker 107A on the right ear. Then, when the person A looks straight at the person C, the person A listens to the utterance of the person C straight.

In other words, the sound image by the utterance of the person C for the person A is not moved depending on the motion of the person A as the person who wears the hearing aid 100.

As described above, in the operation example 2, the hearing aid system of Embodiment 1 is configured such that the sound image by the utterance of the person C for the person A is not moved depending on the motion of the person A who wears the hearing aid 100.

In the acoustic signals output from the left-ear speaker 107B and the right-ear speaker 107A of the binaural speaker 107, (1) the incoming direction of the sound spoken by the person C as a sound source is truly reproduced by the directional sense components which are calculated by the directional sense component calculating section 103 and represent the direction of the sound source with the person who wears the binaural microphone 101 as a base point, and (2) the clearness of the sound spoken by the person C as a sound source is increased by the sound source signals subjected to the directionality processing toward the sound source with the external microphone array 300 as a base point. Therefore, with the hearing aid system of Embodiment 1, it is possible to increase the clearness of sound spoken by a speaker while reproducing the incoming direction of the sound spoken by the speaker.

Figure 5:
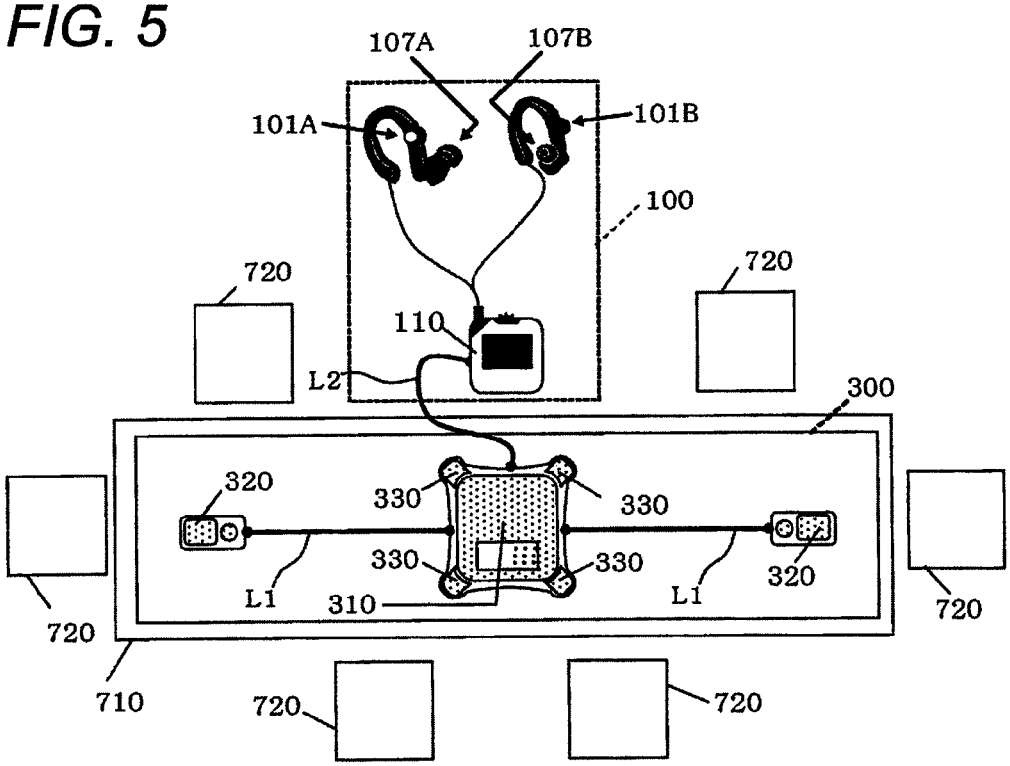
FIG. 5 is a configuration diagram of the hearing aid system of Embodiment 1 and a configuration diagram of a conference system using the hearing aid system.

FIG. 5 is a configuration diagram of the hearing aid system of Embodiment 1 and a configuration diagram of a conference system using the hearing aid system.

The hearing aid system includes the hearing aid 100 and the external microphone array 300. The hearing aid 100 includes a hearing aid main body 110, the right-ear microphone 101A and the right-ear speaker 107A, and the left-ear microphone 101B and the left-ear speaker 107B, which are connected to each other by wires. The external microphone array 300 includes a speakerphone main body 310 and two external microphones 320. The two external microphones 320 and the speakerphone main body 310 are connected to each other by a wire L1. The speakerphone main body 310 includes four internal microphones 330. The hearing aid main body 110 in the hearing aid 100 and the speakerphone main body 310 in the external microphone array 300 are connected to each other by a wire L2.

The hearing aid main body 110 and the speakerphone main body 310 respectively include a power supply, a DSP (Digital Signal Processor), a communication section, a storage section, and a control section.

As shown in FIG. 5, a conference system using a hearing aid system includes the hearing aid system, a desk 710, and a plurality of chairs 720. A plurality of chairs 720 are provided around the desk 710. Sound of a speaker who sits on a chair 720 is input to the external microphone array 300, and the right-ear microphone 101A and the left-ear microphone 101B. The sound of the speaker is output to the binaural speaker 107 as a sound component having high clearness through the external microphone array 300. The sound of the speaker is output to the binaural speaker 107 as a directional sense component through the right-ear microphone 101A and the left-ear microphone 101B. A user of the hearing aid system can clearly listen to the sound of the speaker while perceiving the incoming direction on the basis of the sound component having high clearness and the directional sense component.

Although in the above description, the respective sections are connected to each other by the wires L1 and L2, the respective sections may be connected to each other in a wireless manner. For example, a right-ear unit 110R which includes the right-ear microphone 101A and the right-ear speaker 107A, a left-ear unit 110L which includes the left-ear microphone 101B and the left-ear speaker 107B, and the external microphone array 300 may respectively include a power supply, a DSP, a communication section, a storage section, a control section, and the like, and may perform communication with each other in a wireless manner.

Figure 6:
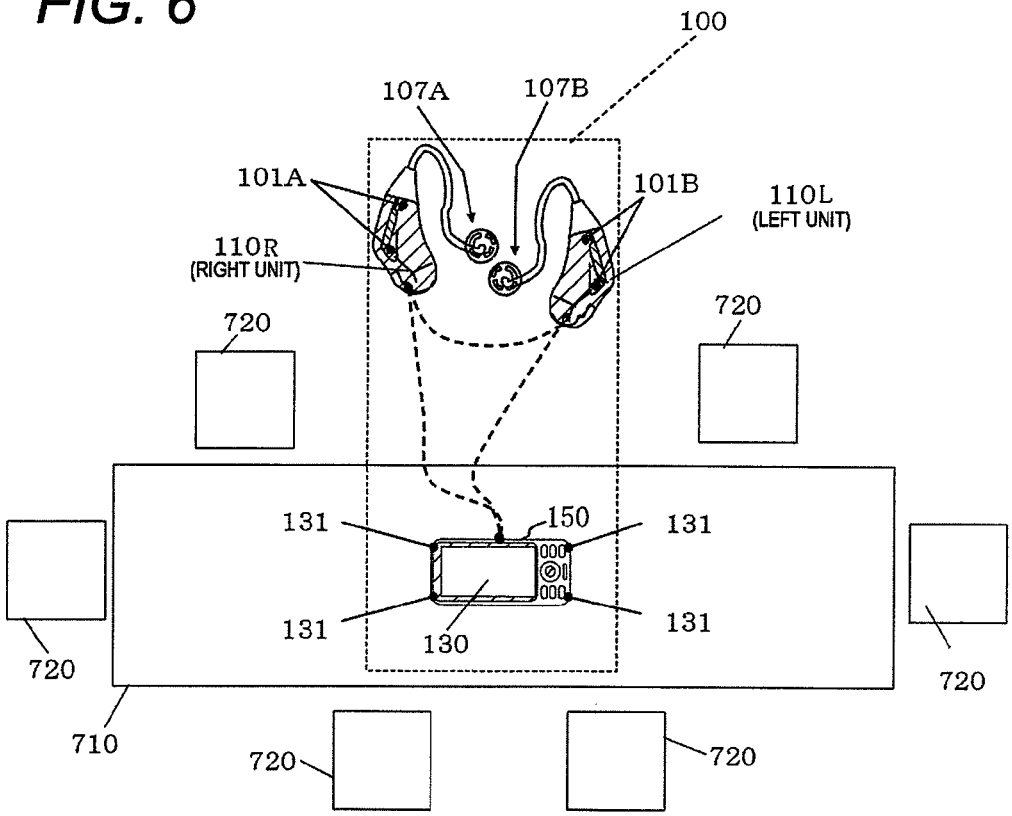
FIG. 6 shows a modification of a hearing aid 100 shown in FIG. 5.

As shown in FIG. 6, in the conference system using the hearing aid system shown in FIG. 5, a remote control unit 130 may be further provided in the hearing aid 100. In FIG. 6, portions where wireless communication is performed are indicated by broken lines. The remote control unit 130 has a basic function for user control, such as changing the output volume level of the hearing aid 100, and when a microphone array having four microphones 131 is mounted, the remote control unit 130 may be used as the external microphone array 300. The remote control unit 130 is mounted on, for example, a mobile phone 150.

In any case, it is preferable that information processing in the hearing aid system is appropriately distributed between a plurality of units in the hearing aid 100 and the external microphone array 300 in consideration of processing delay accompanied with communication or power consumption, regardless of wired or wireless and the configuration of each unit in the hearing aid system.

For example, in FIG. 5, with the block configuration of FIG. 1, it is preferable that a DSP in the speakerphone main body 310 performs sound source input processing and sound source separating processing, and a DSP in the hearing aid main body 110 performs other processing. Thus, communication signals between the external microphone array 300 and the hearing aid 100 may include only separated sound signals, thereby reducing a communication capacity. Sound source separation which has a large amount of processing is performed by the speakerphone main body 310 which can use an AC adapter, thereby suppressing power consumption of the hearing aid main body 110.

For example, in FIG. 6, since a processing delay accompanied with wireless communication becomes conspicuous compared to wired communication, it is preferable to take into consideration the volume of communication.

If an interaural volume difference is used as a directional sense component, it is possible to determine the volume levels of the left and right output signals using a difference between each of the left and right volume levels and a predetermined reference volume level. Thus, there is no processing delay accompanied with the transmission of signals from the left and right units of the hearing aid main body 110 to the remote control unit 130, such that the directional sense component is maintained in a state of nature. Since it is not necessary to directly compare the left and right volume levels with each other, it becomes possible to perform processing separately on the left and right such that the right output signal is generated in the right unit of the hearing aid main body 110, and the left output signal is generated in the left unit of the hearing aid main body 110. Thus, there is no processing delay accompanied with communication between the left and right.

The form of the hearing aid 100 of the hearing aid system of Embodiment 1 is not particularly limited. However, for example, if the hearing aid 100 of the hearing aid system of Embodiment 1 is in a canal form, the hearing aid system of Embodiment 1 can generate a directional sense component in which the direction of the head of the person who wears the binaural microphone 101 and an influence of reflection depending on the size or form of each region (pinna, shoulder, torso) of the person who wears the hearing aid 100 are reflected.

Although in the hearing aid system of Embodiment 1, the external microphone array 300 is provided near the center of the round table 700, the invention is not limited thereto. Each speaker may wear a headset-type external microphone array 300. In this case, the external microphone array has the sound source input section 301, and the sound source separating section 303 is not required.

In the hearing aid system of Embodiment 1, the binaural speaker 107 may be provided in, for example, a headphone.

In the hearing aid system of Embodiment 1, the binaural microphone 101 may be provided in, for example, a headphone.

In the hearing aid system of Embodiment 1, the sound source input section 301 of the external microphone array 300 may have a single microphone, and the external microphone array 300 may be arranged closer to the sound source than the binaural microphone 101.

Embodiment 2

Figure 7:
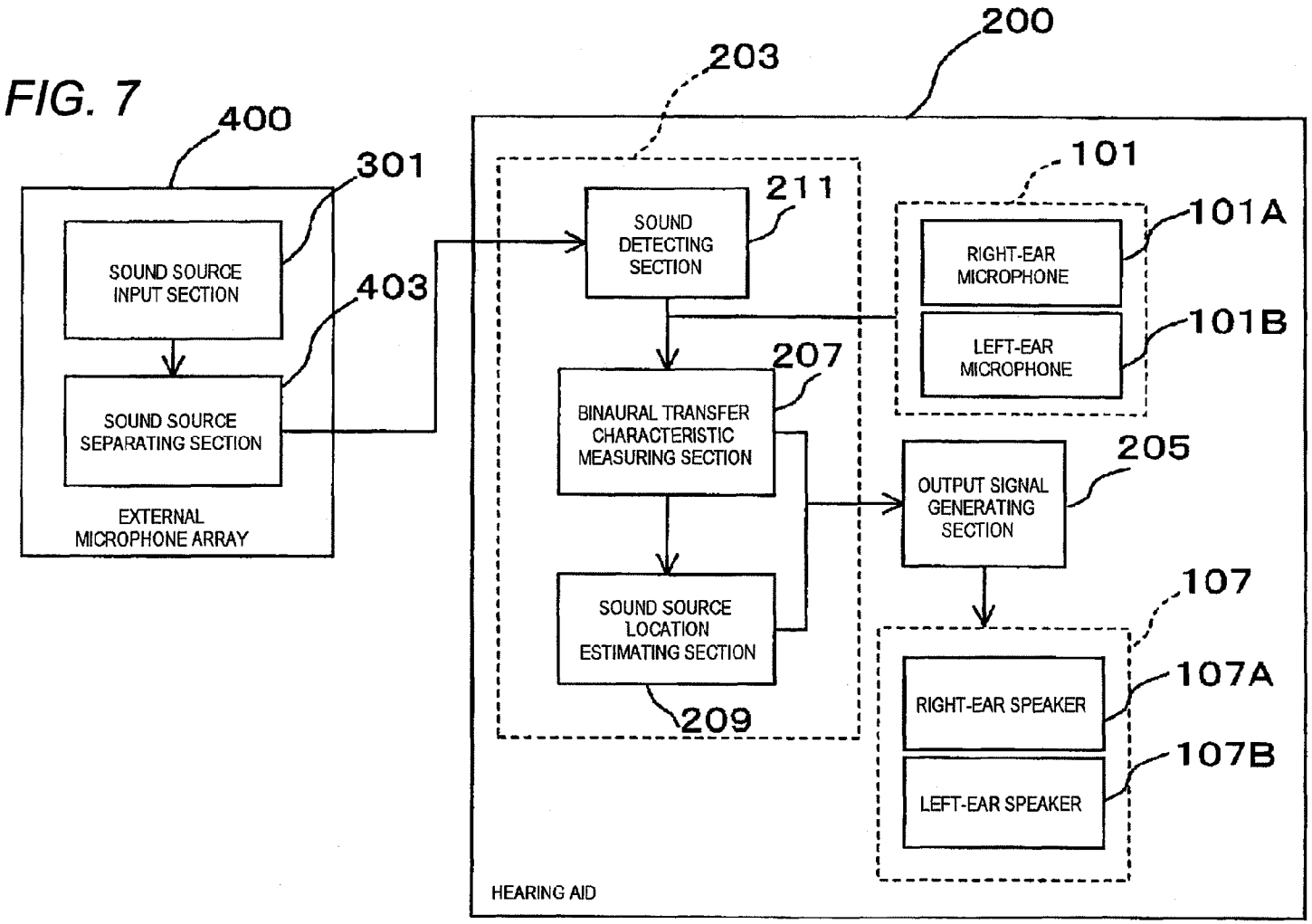
FIG. 7 is a block diagram showing the configuration of a hearing aid system of Embodiment 2.
Figure 8:
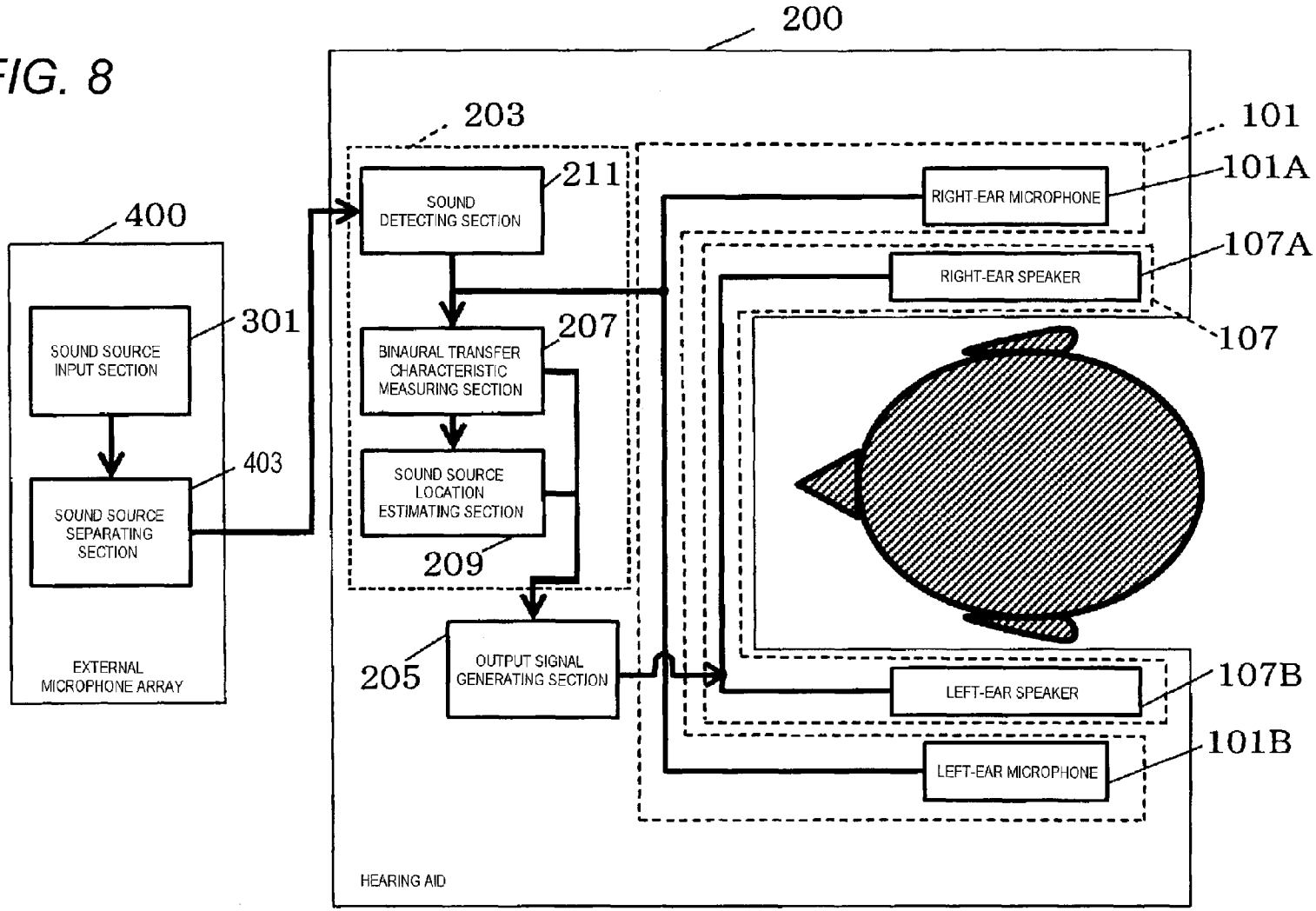
FIG. 8 is a block diagram showing the configuration of the hearing aid system of Embodiment 2 in detail.
Figure 9:
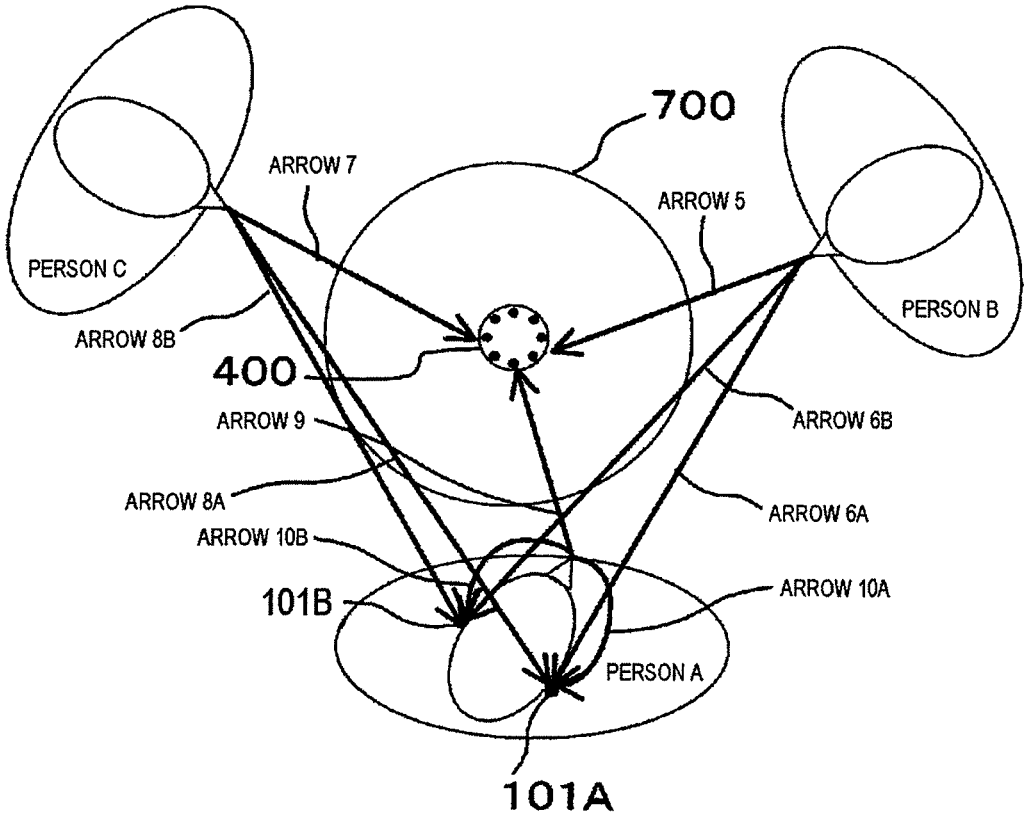
FIG. 9 is a diagram showing a usage example of the hearing aid system of Embodiment 2.
Figure 10:
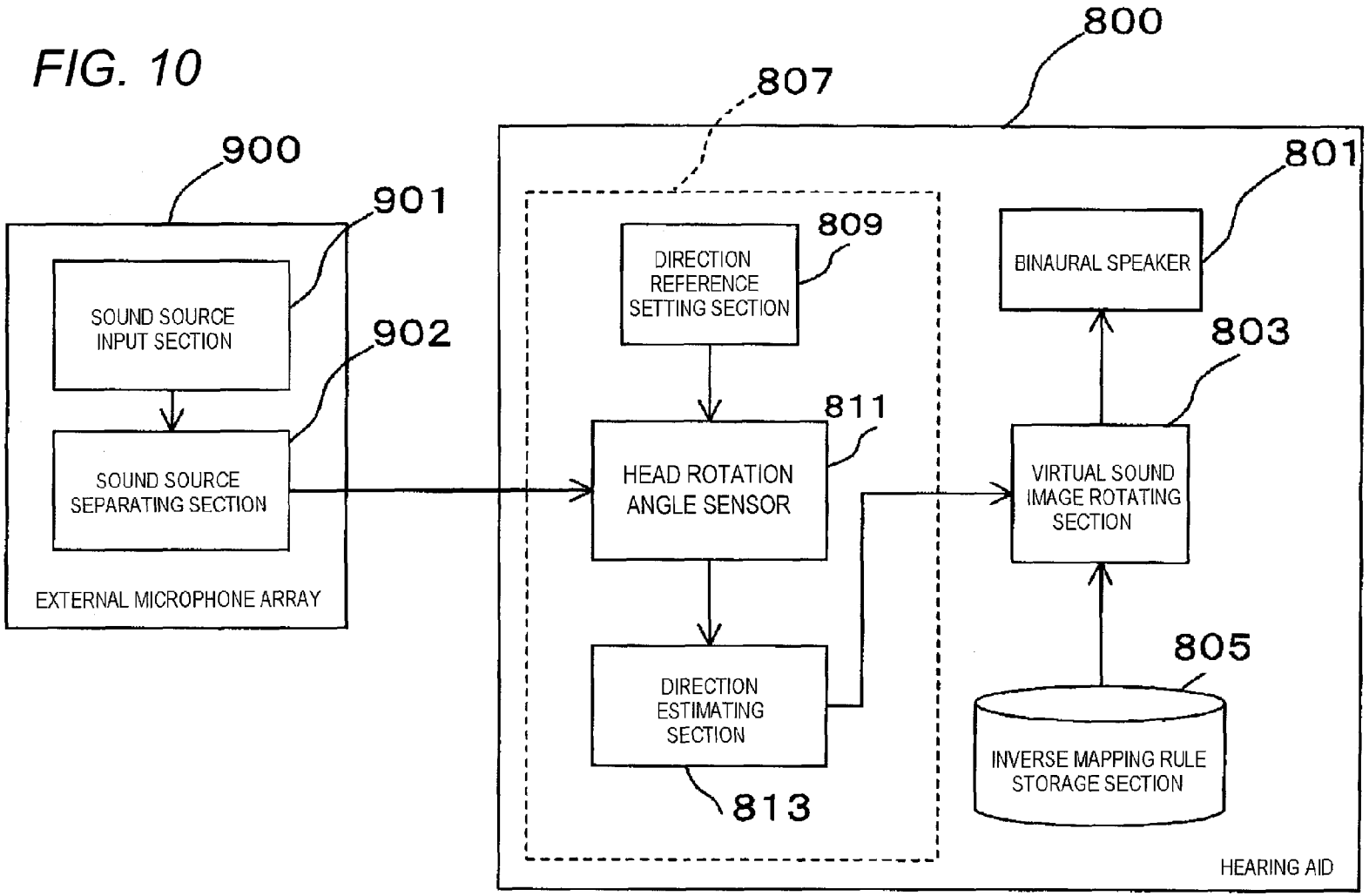
FIG. 10 is a block diagram showing the configuration of a hearing aid system of the related art.

FIG. 7 is a block diagram showing the configuration of a hearing aid system of Embodiment 2. FIG. 8 is a block diagram showing the configuration of the hearing aid system of Embodiment 2 in detail. As shown in FIG. 7, the hearing aid system of Embodiment 2 includes a hearing aid 200 and an external microphone array 400. FIG. 9 is a diagram showing a usage example of the hearing aid system of Embodiment 2.

The configuration of the hearing aid 200 which constitutes a part of the hearing aid system of Embodiment 2 will be described with reference to FIG. 7. A binaural microphone and a binaural speaker in the hearing aid system of Embodiment 2 have the same configuration as the binaural microphone 101 and the binaural speaker 107 of Embodiment 1. Thus, the same reference numerals as those in FIG. 1 are given.

The hearing aid 200 has a right unit which is worn on a right ear and a left unit which is worn on a left ear. The left and right units respectively includes a binaural microphone 101, an output signal generating section 205, a binaural transfer characteristic measuring section 207, a sound source location estimating section 209, a binaural speaker 107, and a sound detecting section 211. The left and right units of the hearing aid 200 perform wireless communication with each other. The left and right units of the hearing aid 200 may perform wired communication with each other.

The binaural microphone 101 has a right-ear microphone 101A which constitutes a part of the right unit and a left-ear microphone 101B which constitutes a part of the left unit. The binaural microphone 101 receives sound coming from sound sources to a person who wears the hearing aid 200 as input to the left and right ears of the person who wears the hearing aid 200 and converts the input sound to acoustic signals. The converted acoustic signals are transferred to the binaural transfer characteristic measuring section 207 so as to obtain the transfer functions of the left and right ears of the person who wears the hearing aid 200.

As described below, the sound detecting section 211 receives respective sound source signals separated by a sound source separating section 403 of the external microphone array 400, and detects sound a person who speaks from the sound source signals. The sound detecting section 211 obtains the power of a predetermined time segment in each sound source signal separated for each sound source. A sound source in which the power of the predetermined time segment is equal to or greater than a threshold value is detected as the sound of the person who speaks. The sound detecting section 211 may use a parameter (for example, a ratio of power by a comb-type filter with a pitch supposed and broadband power) representing a harmonic structure, as well as the power, as elements which are used to detect sound of a person who speaks, in addition to power.

The binaural transfer characteristic measuring section 207 obtains a transfer function (hereinafter, referred to as right transfer characteristic) between the sound source signal (hereinafter, referred to as sound signal) detected by the sound detecting section 211 as the sound of the person who speaks and the left acoustic signal received from the right-ear microphone 101A. Simultaneously, the binaural transfer characteristic measuring section 207 obtains a transfer function (hereinafter, referred to as left transfer characteristic) between the sound signal and the left acoustic signal received from the left-ear microphone 101B. The binaural transfer characteristic measuring section 207 associates the transfer characteristics of the respective ears with the directions (hereinafter, referred to as sound source directions) representing the directions of the sound sources with the external microphone array 400 as a base point. For this reason, even when a plurality of sound signals are detected as sound, the binaural transfer characteristic measuring section 207 can express the sound source directions of the respective sound sources.

In the hearing aid system of Embodiment 2, the transfer characteristics of the respective ears obtained by the binaural transfer characteristic measuring section 207 correspond to the directional sense components of Embodiment 1.

When a plurality of speakers speak simultaneously, that is, when the sound detecting section 211 detects a plurality of sound source signals separated for each sound source simultaneously, the binaural transfer characteristic measuring section 207 stops the measurement of the transfer characteristics of the respective ears. In this case, the transfer functions immediately before the measurement of the transfer functions of the respective ears stops are used, thereby maintaining the sound source directional sense of each person.

The sound source location estimating section 209 can estimate the locations of the respective sound sources on the basis of the left and right transfer functions which are obtained by the binaural transfer characteristic measuring section 207 and associated with the sound source directions.

First, the sound source location estimating section 209 obtains the incoming time of sound from the external microphone array 400 to the binaural microphone 101 from the time having a first peak on the impulse response of the transfer characteristic of the ears associated with the sound source direction. The distance of each sound source from the person who wears the hearing aid 200 can be estimated from the incoming time. The sound source location estimating section 209 calculates a mutual correlation value from the impulse responses of the transfer functions of the left and right ears while shifting the time, and obtains the time, at which the mutual correlation value is maximized, as an interaural time difference.

The sound source location estimating section 209 regards a sound source, in which the incoming time has a minimum value and the interaural time difference is close to 0, from among a plurality of sound sources as the utterance of the person himself/herself who wears the hearing aid 200. Thus, the sound source location estimating section 209 can estimate the locations of the sound sources on the basis of the transfer functions of the left and right ears which are obtained by the binaural transfer characteristic measuring section 207 and associated with the sound source directions. The estimation result of the sound source location estimating section 209 is referenced by the output signal generating section 205.

As described above, in the hearing aid system of Embodiment 2, the sound detecting section 211, the binaural transfer characteristic measuring section 207, and the sound source location estimating section 209 have the same function as the directional sense component calculating section of Embodiment 1.

The output signal generating section 205 generates left and right acoustic signals, which are respectively output from the right-ear speaker 107A and the left-ear speaker 107B of the binaural speaker 107, from the left and right transfer characteristics measured by the binaural transfer characteristic measuring section 207 and the left and right sound signals. The output signal generating section 205 superimposes the impulse responses of the transfer functions representing the left and right transfer characteristics on the sound signals of the first microphone system to generate the left and right acoustic signals.

The output signal generating section 205 references the estimation result of the sound source location estimating section 209 as necessary and determines whether or not the sound source of the left and right sound signals is the person who wears the hearing aid 200. When the sound source location estimating section 209 determines that the sound source is the person who wears the hearing aid 200, the output signal generating section 205 outputs the sound signals of the second microphone system to the binaural speaker 107 without outputting the sound signals of the first microphone system to the binaural speaker 107. Thus, the sound of the person who wears the hearing aid can be clarified, and sound with little time delay can be heard naturally.

The binaural speaker 107 has a right-ear speaker 107A which constitutes a part of the right unit and a left-ear speaker 107B which constitutes a part of the left unit. The binaural speaker 107 outputs the sound source signals generated by the output signal generating section 205 as left and right acoustic signals to the left and right ears of the person who wears the hearing aid 200.

Next, the configuration of the external microphone array 400 which constitutes a part of the hearing aid system of Embodiment 2 will be described with reference to FIGS. 7 and 8. In the hearing aid system of Embodiment 2, the sound source input section 301 of the external microphone array has the same configuration as the sound source input section of the external microphone array of Embodiment 1. Thus, the same reference numerals as those in FIG. 1 are given.

The external microphone array 400 includes a sound source input section 301 and a sound source separating section 403. In the hearing aid system of Embodiment 2, the external microphone array 400 is provided at a location closer to speakers B and C than the binaural microphone 101 of the hearing aid 200. The external microphone array 400 performs wireless communication with the left and right units of the hearing aid 200. The external microphone array 400 may perform wired communication with the left and right units of the hearing aid 200.

The sound source input section 301 receives sound coming from sound sources to the external microphone array 400 as input and converts the input sound to acoustic signals. The sound source input section 301 has a plurality of microphones.

The acoustic signals of the microphones converted by the sound source input section 301 are transferred to the sound source separating section 403.

The sound source separating section 403 detects the direction of the sound source with the external microphone array 400 as a base point using a difference in the incoming time of the sound coming from the sound source to the microphones.

The sound source separating section 403 adds the acoustic signals of the microphones on the basis of the spatial arrangement of the microphones while taking into consideration the delay time of the sound to the microphones. The sound source separating section 403 generates sound source signals subjected to directionality processing toward the sound source with the external microphone array 400 as a base point in the above-described manner, and transmits the sound source signals to the sound detecting section 211 of the hearing aid 200 in a wireless manner.

With regard to the sound source signals generated by the sound source separating section 403, sound coming from a target sound source is highlighted (subjected to directionality processing) with the external microphone array 400 as a base point. For this reason, in the sound source signals generated by the sound source separating section 403, sound other than the sound of the target sound source is suppressed, and the sound of the target sound source is clarified. When the location of the external microphone array 400 is closer to the location of the sound source than the location of the binaural microphone 101, in the sound source signals generated by the sound source separating section 403, the sound of the target sound source is further clarified.

The sound source separating section 403 may perform sound source separation by ICA (independent component analysis). At this time, in order that power is used in the sound detecting section 211, diagonal elements of an inverse matrix of a separation matrix are multiplied to separate components to restore power information.

Operation Example

As shown in FIG. 9, it is assumed that a person A who wears hearing aid 200, a person B, and a person C have a meeting around a round table 700 on which the external microphone array 400 is provided near the center thereof. In FIG. 9, while the person B and the person C are speaking, the person A looks straight at the person B and listens to the utterance of the person B.

Sound spoken by the person B, the person C, and the person A is input from two microphone systems and converted to left and right acoustic signals. A first microphone system is a plurality of microphones which constitute the sound source input section of the external microphone array 400, and a second microphone system is the binaural microphone 101 of the hearing aid 200.

(First Microphone System)

In the sound source input section 301 of the external microphone array 400, sound (arrow 5) coming from the person B to the external microphone array 400 is input and converted to acoustic signals. Similarly, in the sound source input section 301 of the external microphone array 400, sound (arrow 7) coming from the person C to the external microphone array 400 is converted to acoustic signals. In the sound source input section 301 of the external microphone array 400, sound (arrow 9) coming from the person A to the external microphone array 400 is also converted to acoustic signals. A plurality of microphones which constitute the sound source input section 301 of the external microphone array 400 collect the sound of the utterances coming from the person B, the person C, and the person A as a sound source. The acoustic signals converted by the sound source input section 301 are transferred to the sound source separating section 403.

In the sound source separating section 403, for example, the sound source direction which represents the direction of the sound source with the external microphone array 400 as a base point using a difference in the incoming time of the sound spoken by the person B reaching the microphones.

In the sound source separating section 403, the acoustic signals of the microphones are added on the basis of the spatial arrangement of the microphones while taking into consideration the delay time of the sound to the microphones, and subjected to directionality processing toward the sound source with the external microphone array 400 as a base point. The acoustic signals subjected to the directionality processing are transmitted to the sound detecting section 211 of the hearing aid 200 in a wireless manner as sound source signals subjected to directionality processing toward the sound source with the external microphone array 400 as a base point.

(Second Microphone System and Hearing Aid 200)

In the left and right microphones 101A and 101B of the binaural microphone 101 of the hearing aid 200, sound (arrow 6A, arrow 8A, arrow 10A, arrow 6B, arrow 8B, or arrow 10B) spoken by each person (the person B, the person C, or the person A) coming from each sound source is input and converted to acoustic signals.

The converted acoustic signals of each sound source are transferred from the microphones 101A and 101B to the binaural transfer characteristic measuring section 207.

In the sound detecting section 211, the sound of each of the person B, the person C, and the person A is detected from each of the sound source signals received from the sound source separating section 403 of the external microphone array 400.

In the sound detecting section 211, the power of a predetermined time segment is obtained in each sound source signal separated for each sound source. A sound source in which the power of the predetermined time segment is equal to or greater than a threshold value is detected as the sound of the person who speaks. The detected sound of the person who speaks is detected from the sound source signal subjected to the directionality processing by the sound source separating section 403, and is thus significantly clarified.

Each sound source signal (hereinafter, referred to as sound signal) from which the sound of a person who speaks is detected is transferred to the binaural transfer characteristic measuring section 207.

In the binaural transfer characteristic measuring section 207, a transfer function between the sound signal of each sound source (the person B, the person C, or the person A) transferred from the sound detecting section 211 and the acoustic signal transferred from the right-ear microphone 101A is obtained. Similarly, in the binaural transfer characteristic measuring section 207, a transfer function between the sound signal of each sound source (the person B or the person C) transferred from the sound detecting section 211 and the acoustic signal transferred from the left-ear microphone 101B is obtained.

In the binaural transfer characteristic measuring section 207, the transfer characteristics of the ears of each sound source (the person B, the person C, or the person A) are associated with the sound source direction representing the direction of the sound source with the external microphone array 400 as a base point.

When two or more persons speak simultaneously, in the binaural transfer characteristic measuring section 207, the measurement of the transfer functions of the ears stops. In this case, the transfer functions immediately before the measurement of the transfer functions of the ears stops are used.

The transfer characteristics of the ears of each sound source associated with the sound source direction are transferred to the output signal generating section 205 and the sound source location estimating section 209.

In the sound source location estimating section 209, the location of each sound source can be estimated on the basis of the transfer functions of the left and right ears which are obtained by the binaural transfer characteristic measuring section 207 and associated with the sound source direction representing the direction of the sound source with the external microphone array 400 as a base point.

In FIG. 9, the utterance of the person A as the person who wears the hearing aid 200 is detected as a sound source, in which the incoming time has a minimum value (a difference in the length between arrow 10B and arrow 9 is smaller than a difference in the length between arrow 6B and arrow 5 or the length of arrow 8B and arrow 7), and the interaural time difference is close to 0 (arrow 10A and arrow 10B substantially has the same length), from among a plurality of sound sources.

In the output signal generating section 205, the impulse response of the transfer functions representing the transfer characteristics of the ears of each sound source associated with the sound source direction are superimposed on the left and right sound signals of each sound source to synthesize the left and right acoustic signals which are output from the right-ear speaker 107A and the left-ear speaker 107B of the binaural speaker 107. In FIG. 9, if the sound source location estimating section 209 detects the utterance of the person A as the person who wears the hearing aid 200, in the output signal generating section 205, the sound signals of the second microphone system are output to the binaural speaker 107.

In the binaural speaker 107, the left and right acoustic signals synthesized by the output signal generating section 205 are respectively output from the right-ear speaker 107A and the left-ear speaker 1078.

As described above, in the hearing aid system of Embodiment 2, the left and right acoustic signals which are generated from the left and right sound signals, which are processed by the external microphone array 400 with the sound of each sound source clarified, and the left and right transfer functions, which are obtained by the binaural transfer characteristic measuring section 207 of the hearing aid 200 and associated with the sound source direction, are output from the binaural speaker 107. For this reason, in the hearing aid system of Embodiment 2, it is possible to increase the clearness of sound spoken by a speaker while reproducing the incoming direction of the sound spoken by the speaker.

In the hearing aid system of Embodiment 2, the form of the hearing aid 200 is not particularly limited. For example, if a canal type is used, the left and right acoustic signals synthesized by the output signal generating section 205 include the direction of the head when a person who speaks wears the hearing aid 200 and the influence of reflection from the size or form of each region (pinna, shoulder, torso) of the person who speaks in the left and right transfer characteristics. For this reason, in the hearing aid system of Embodiment 2, the person who wears the hearing aid 200 can feel the directional sense of the sound output from the binaural speaker 107 in real time.

In the hearing aid system of Embodiment 2, the configuration diagram of the hearing aid system and the configuration diagram of the conference system shown in FIG. 5 in Embodiment 1 can be applied.

This application is based on Japanese Patent Application No. 2009-012292, filed on Jan. 22, 2009, the content of which is incorporated herein by reference.

The hearing aid system of the invention can increase the clearness of speech spoken by a person while reproducing the incoming direction of the speech spoken by the person without using an inverse mapping rule, and is useful as a hearing aid system or the like.

The invention claimed is:

1. A hearing aid system comprising:

a sound source input section configured to receive sounds from sound sources as an input thereof and to convert the input sounds to first acoustic signals;

a sound source separating section configured to separate the first acoustic signals converted by the sound source input section into sound source signals corresponding to respective sound sources;

a binaural microphone disposed at left and right ears and, and being configured to receive the sounds from the sound sources as an input thereof and to convert the input sounds to left and right second acoustic signals;

a directional sense component calculating section configured to calculate a directional sense component representing a directional sense of the sound sources with respect to the binaural microphone as a base point, based on the left and right second acoustic signals converted by the binaural microphone;

an output signal generating section configured to generate left and right output acoustic signals by synthesizing the sound source signals and the directional sense component; and a binaural speaker configured to output the left and right output acoustic signals generated by the output signal generating section.

2. The hearing aid system according to claim 1, wherein the directional sense component calculating section is configured to calculate at least one of an interaural time difference and an interaural volume difference based on the left and right second acoustic signals, and wherein the directional sense component calculating section is configured to set at least one of the interaural time difference and the interaural volume difference as the directional sense component, and wherein the output signal generating section is configured to delay the sound source signals by an amount corresponding to the interaural time difference, or control a volume level of the binaural speaker so as to be lowered by an amount corresponding to the interaural volume difference.

3. The hearing aid system according to claim 1, wherein the directional sense component calculating section is configured to calculate, for each of the sound sources, a transfer characteristic between the sound source signal from the sound source separating section and the left and right second acoustic signals from the binaural microphone as the directional sense component, and wherein the output signal generating section is configured to superimpose an impulse response of transfer functions representing the transfer characteristics of the left and right ears of each sound source associated with a sound source direction, and synthesizes the left and right output acoustic signals.

4. The hearing aid system according to claim 3, wherein the directional sense component calculating section is configured to detect an utterance duration from the sound source signal acquired from the sound source separating section for each of the sound sources, and wherein if the utterance durations of a plurality of sound sources are detected simultaneously, the directional sense component calculating section uses a value immediately before the detection of the utterance durations of the plurality of sound sources as the transfer characteristic.

5. The hearing aid system according to claim 3, wherein the directional sense component calculating section is configured to estimate a location of each of the sound sources based on the transfer characteristic, and wherein when the directional sense component calculating section estimates that the location of the sound source is at a person wearing the binaural microphone, the output signal generating section outputs the second acoustic signals to the binaural speaker.

6. The hearing aid system according to claim 1, wherein the sound source separating section is configured to generate sound source signals subjected to directionality processing toward the sound sources with the sound source input section as a base point.

7. The hearing aid system according to claim 1, wherein the sound source input section is a single microphone.

8. The hearing aid system according to claim 1, wherein the sound source separating section is configured to perform sound source separation by independent component analysis.

9. A hearing aid system comprising:

a plurality of sound source input sections disposed in headsets and configured to receive sounds from respective sound sources as an input thereof and to convert the input sounds thereof to first acoustic signals;

a binaural microphone configured to be disposed at left and right ears and configured to receive the sounds from the sound sources as an input thereof and to convert the input sounds thereof to left and right second acoustic signals;

a directional sense component calculating section configured to calculate a directional sense component representing a directional sense of the sound sources with respect to the binaural microphone as a base point, based on the left and right second acoustic signals converted by the binaural microphone;

an output signal generating section configured to generate left and right output acoustic signals by synthesizing the first acoustic signals and the directional sense component; and a binaural speaker configured to output the left and right output acoustic signals generated by the output signal generating section.

* * * * *